United States Patent [19]

Perrin

[11] Patent Number: 4,838,610

[45] Date of Patent: Jun. 13, 1989

[54] PROTECTIVE COVER DEVICES FOR UPHOLSTERED FURNITURE

[76] Inventor: Margy L. Perrin, 7507 San Carlos Dr., Ft. Pierce, Fla. 34951

[21] Appl. No.: 188,846

[22] Filed: May 2, 1988

[51] Int. Cl.[4] ..... A47C 27/00

[52] U.S. Cl. ..... 297/225; 297/228

[58] Field of Search ..... 24/266, 130, 306, 442; 297/225, 228

[56] References Cited

U.S. PATENT DOCUMENTS

| | | | |
|---|---|---|---|
| 3,858,256 | 1/1975 | Beer | 297/225 X |
| 4,355,444 | 10/1982 | Haney | 24/130 X |

FOREIGN PATENT DOCUMENTS

| | | | |
|---|---|---|---|
| 450579 | 8/1948 | Canada | 297/228 |
| 2632814 | 1/1978 | Fed. Rep. of Germany | 24/442 |
| 895550 | 5/1962 | United Kingdom | 297/225 |

*Primary Examiner*—James T McCall

*Attorney, Agent, or Firm*—Carroll F. Palmer

[57] ABSTRACT

A protective cover device for upholstered furniture, that is not form-fitted like slipcovers but, unlike throws, will remain in proper position, is a tub made of fabric of size that enables it to cover the piece of upholstered furniture to be protected thereby. Such fabric tub has a continuous integral peripheral bottom portion that defines a single opening thereinto, there is a hem continuously around the bottom portion and a drawstring is carried in the hem. The hem has at least one opening through which the drawstring extends to permit it to be manipulated to tighten the bottom portion of the tub against the base of the piece of upholstered furniture. In one embodiment, the protective cover device includes a cam cleat to fix the drawstring in an bottom portion tightening condition. Other embodiments are disclosed having other arrangements that permit the drawstring to be fixed in an bottom portion tightening condition about the base of the piece of upholstered furniture.

6 Claims, 1 Drawing Sheet

PROTECTIVE COVER DEVICES FOR UPHOLSTERED FURNITURE

BACKGROUND OF THE INVENTION

1. Field of the Invention

This invention relates to protective cover devices for upholstered furniture.

2. Description of the Prior Art

Owners of upholstered furniture, e.g., armchairs, couches, settees, etc., conventionally seek to protect the upholstery fabric covering such furniture against soiling during normal day to day useage so the it can have a "fresh" look on special occasions. Form fitting covers tailored to the precise dimensions of the furniture are frequently used for this purpose and a referred to in the trade as "slipcovers". However, the task of installing and removing such slip covers from the furniture renders the transformation of the furniture from covered to uncovered and back a very onerous task.

As alternatives to the form fitting slipcovers, that are more easily installed and removed, baggy fitting covers for couches, divans, etc. have been developed, see U.S. Pat. Nos. 2,316,987 and 3,506,049. However, while such covers, called "throws" in the trade, improve the installation and removability over fitted slip covers, they seriously detract from the stylish appearance of the furniture when covered thereby. Further, throws do not remain in position on the furniture when persons sit thereon, i.e., the throws move around, usually ending up in a heap after "riding up" the back and over the arms of the chair or sofa on which they have been placed. Accordingly, a need exists for protective covers for upholstered furniture that are more easily installed and removed than fitted slipcovers, but still provide a stylish appearance to the furniture covered therewith and stay in place. The present invention provides new protective covers having such qualities.

Of related interest to this invention is the prior use of drawstrings and other known structures for holding and tightening covers about pieces of furniture and other objects, e.g., see U.S. Pat. Nos. 1,219,790; 1,820,040; and 3,066,435.

OBJECTS

A principal object of the invention is the provision of improved forms of protective cover devices for upholstered furniture that stay in place.

Further objects include the provision of:

1. Improved forms of protective cover devices for upholstered furniture that can be quickly and easily removed from the furniture and when installed provide the furniture with a stylish, "fitted" appearance, even under stress of heavy activity, e.g., actions of dogs or children.

2. Such protective cover devices that remain substantially in the position in which they are placed on upholstered furniture even when persons sit upon such covered furniture.

3. Such protective cover devices that can be made at much less expense than fitted slipcovers thereby making it possible for a larger number of persons to purchase and own stylish looking protective covers for their upholstered furniture.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The objects are accomplished, in part, in accordance with the invention by the provision of a protective cover device for upholstered furniture which is in the form of a fabric tub of size that enables it to cover the piece of upholstered furniture to be protected thereby. Such tub has a continuous integral peripheral bottom portion that defines a single opening thereinto, a hem continuously around the bottom portion, a drawstring carried in the hem and at least one opening in the hem through which the drawstring extends to permit the drawstring to be manipulated to tighten the bottom portion of the tub against the base of the piece of upholstered furniture.

In a first embodiment, the new protective cover device includes cam means to cleat the drawstring in an bottom portion tightening condition.

In a second embodiment, an end of the drawstring has a first strip of "Velcro" fastened thereto and a second matching strip of "Velcro" is stitched to the inside surface of the hem to permit the drawstring to be fixed in an bottom portion tightening condition by interaction of the first and second "Velcro" strips.

In a third embodiment, the hem has a pair of openings therein through which .opposite ends of the drawstring extend permitting the ends to be tied together to fix the drawstring in an bottom portion tightening condition.

The new cover devices can be made in a balloon style in which the drawstring is located at the very bottom of the cover when installed on a piece of furniture. The devices can also be made in a country style in which the drawstring is positioned above the very botton, e.g., six inches above, so that the portion below the drawstring creates a ruffle when such cover is installed on a piece of furniture.

BRIEF DESCRIPTION OF THE DRAWINGS

A more complete understanding of the invention may be had by the reference to the accompanying drawings in which.

DESCRIPTION OF THE PREFERRED EMBODIMENTS

Referring in detail to the drawings, in which identical parts are identically marked, they show one of the new protective cover devices 2*a* for an upholstered chair 4 and another new cover device 2*b* for an upholstered sofa 6.

Figure 1:
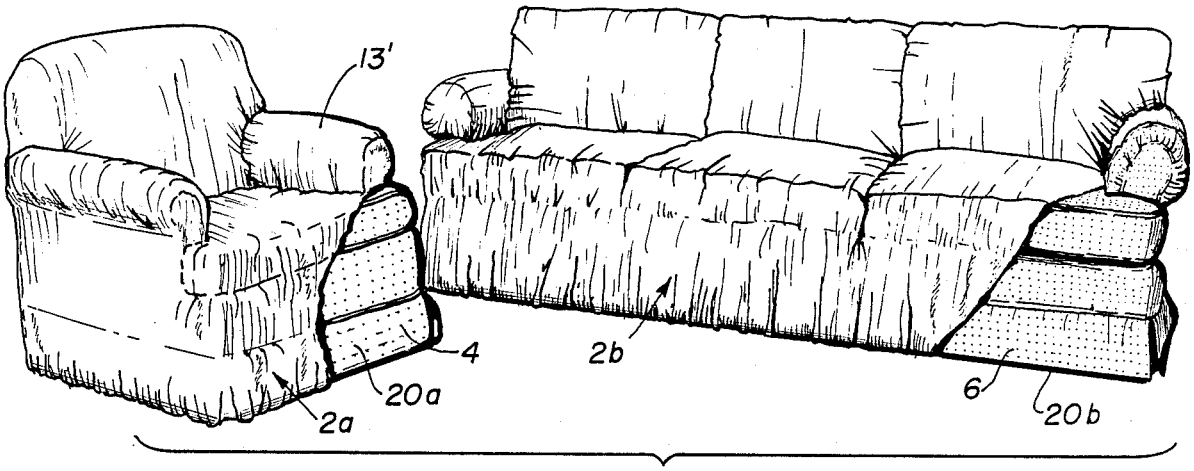
FIG. 1 is perspective view of an upholstered arm chair and an upholstered sofa equipped with protective cover devices of the invention wherein portions of the cover devices are partially fragmented for the purpose of illustration.
Figure 2:
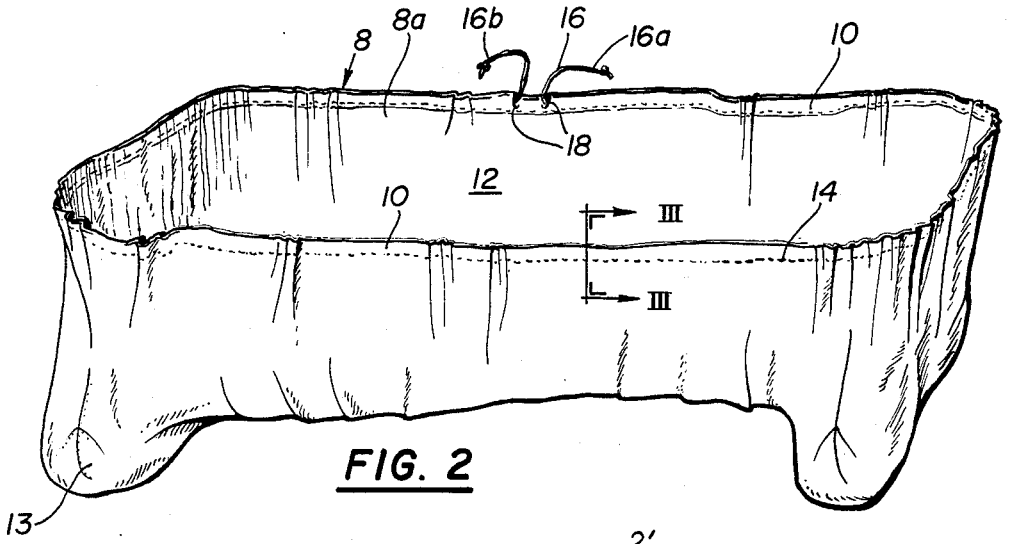
FIG. 2 is a perspective view of a protective cover device of the invention of the third embodiment type, turned upside down from the position it assumes in covering a piece of upholstered furniture.
Figure 3:
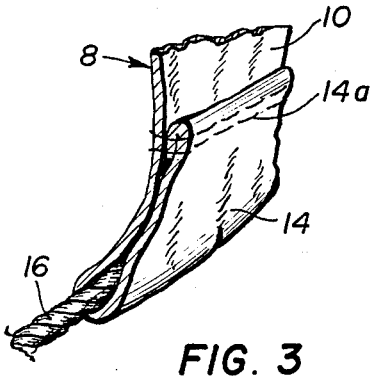
FIG. 3 is a fragmentary, sectional view taken on the line III—III of FIG. 2.

With reference to FIG. 2, the devices 2*a* & 2*b* both basically are in the form of a tub 8 made of fabric 8*a* of size that enables it to cover the piece of upholstered furniture to be protected thereby.

The tub 8 has a continuous integral peripheral bottom portion 10 that defines a single opening 12 into the tub 8. The tub 8 may include dished portions 13 that help to shape arm sections 13' in the cover devices when installed on armed upholstered furniture.

There is a hem 14 formed with stitching 14*a* continuously around the bottom portion 10, a drawstring 16 is carried in the hem and there is at least one opening 18 in the hem 14 through which the drawstring 16 extends to permit the drawstring 16 to be manipulated to tighten the bottom portion 10 of the tub 8 against the base 20*a* & 20*b* of the piece of upholstered furniture 2*a* or 2*b* respectively.

In the tub 8, the hem 10 has a pair of openings 18 therein through which opposite ends 16*a* & 16*b* of the drawstring 16 extend permitting the ends to be tied together to fix the drawstring 16 in an bottom portion tightening condition.

Figure 4:
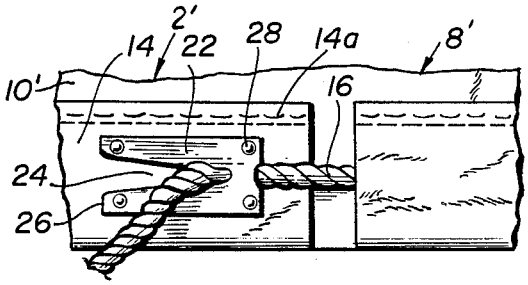
FIG. 4 is a fragmentary, lateral view of a protective cover device of the invention of the first embodiment type.
Figure 5:
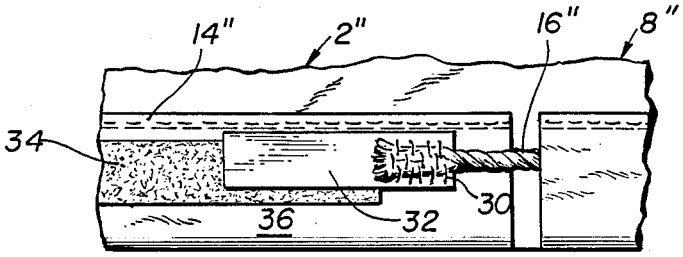
FIG. 5 is a fragmentary, lateral view of a protective cover device of the invention of the second embodiment type.

The tub 8' of protective cover device 2' of FIG. 4 includes cam means 22 to cleat the drawstring 16 in an bottom portion tightening condition. The means 22 has a V-shaped opening 24 between two legs 26 and is fixed to the hem 14 by rivets 28. The drawstring 16 jambs into the apex end of the opening 24 to cleat it and hold it at the selected length needed to tighten the bottom portion 10' against the base of the furniture (not shown).

The tub 8'' of protective cover device 2'' has an end of the drawstring 16'' fixed by stitching 30 to a first strip of "Velcro" 32. A second matching strip of "Velcro" 34 is stitched to the inside surface 36 of the hem 14'' to permit the drawstring 16'' to be fixed in a selected tightening condition by interaction of the strips 32 & 34.

The embodiments of the invention in which an exclusive property or privilege is claimed are defined as followed:

1. A protective cover device for upholstered chairs, couches, divans and like upholstered furniture having arms, a back and at least one seat cushion which comprises:

a fabric tub of size substantially larger than said piece of upholstered furniture to be protected thereby permitting said fabric tub to completely cover said piece of upholstered furniture while portions thereof can be tucked into spaces existing between said seat cushion and said arms and back to give the covered furniture a finished appearance, said fabric tub including dished portions that shape arm sections to cover said arms of said piece of upholstered furniture and a continuous integral peripheral bottom portion that defines a single opening thereinto, a hem continuously around said bottom portion, a drawstring carried in said hem and at least one opening in said hem through which said drawstring extends to permit said drawstring to be manipulated to tighten said bottom portion of said fabric tub against the base of said piece of upholstered furniture.

2. The protective cover device of claim 1 that includes cam means to cleat said drawstring in an bottom portion tightening condition.

3. The protective cover device of claim 1 wherein an end of said drawstring has a first strip of "Velcro" fastened thereto and a second matching strip of "Velcro" is stitched to the inside surface of said hem to permit said drawstring to be fixed in an bottom portion tightening condition by interaction of said first and second strips.

4. The protective cover device of claim 1 wherein said hem has a pair of openings therein through which opposite ends of said drawstring extend permitting said ends to be tied together to fix said drawstring in an bottom portion tightening condition.

5. The protective cover device of claim 1 wherein said hem is located at the bottom edge of said bottom portion of said tub.

6. The protective cover device of claim 1 wherein said hem is located a short distance above the bottom edge of said bottom portion of said tub.

* * * * *